United States Patent [19]

Mackie

[11] 4,093,136

[45] June 6, 1978

[54] TEXTILE, YARN OR TAPE WINDING MACHINES

[75] Inventor: Gordon Mackie, Ladyhill, Ireland

[73] Assignee: James Mackie & Sons Limited, Belfast, Ireland

[21] Appl. No.: 690,746

[22] Filed: May 27, 1976

[30] Foreign Application Priority Data

Jun. 2, 1975 United Kingdom ..... 23800/75

[51] Int. Cl.[2] ..... B65H 59/00

[52] U.S. Cl. ..... 242/45

[58] Field of Search ..... 242/45, 75.5, 75.51, 242/18 R, 18 PW, 25; 310/103

[56] References Cited

U.S. PATENT DOCUMENTS

| | | | |
|---|---|---|---|
| 1,862,267 | 6/1932 | Honig | 310/103 |
| 2,254,221 | 9/1941 | Hubbard | 242/25 |
| 3,578,795 | 5/1971 | Polese | 242/45 |
| 3,670,975 | 6/1972 | Tomimatsu | 242/45 |
| 3,672,582 | 6/1972 | Allam et al. | 242/18 R |

*Primary Examiner*—Leonard D. Christian
*Attorney, Agent, or Firm*—Pollock, Vande Sande & Priddy

[57] ABSTRACT

A yarn or tape winding machine comprising a take-up spindle which is arranged to be driven by a drive, the torque/speed of which is variable in accordance with the setting of a torque variator device and a control device for the torque variator, including means in the path of the tape or yarn prior to the take-up spindle to sense the tension of the tape or yarn and a control drive for the variator which is mechanically connected to the tension sensing means and which is effective to adjust the variator to alter the torque applied to the winding spindle when the yarn or tape tension varies beyond predetermined limits.

8 Claims, 2 Drawing Figures

TEXTILE, YARN OR TAPE WINDING MACHINES

Figure 1:
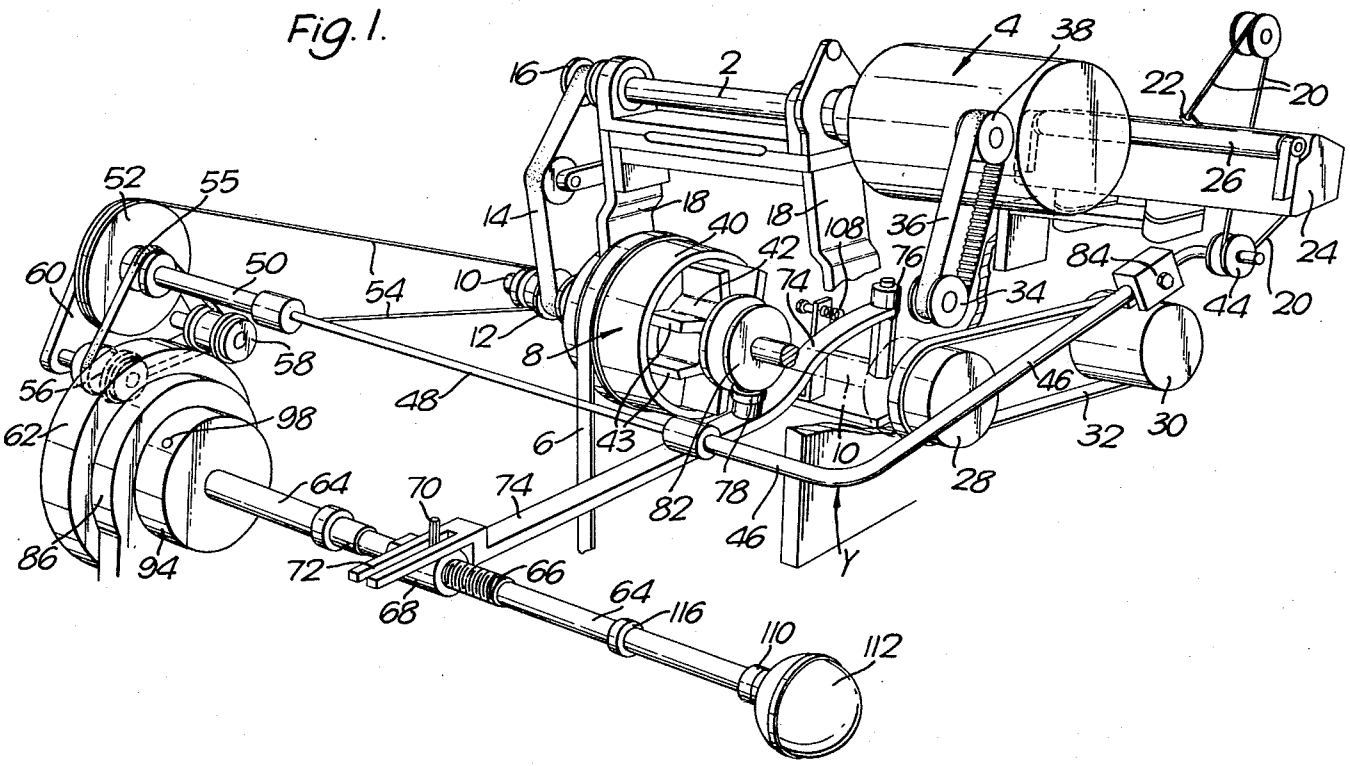

This invention relates to textile yarn (including filaments) or tape (either of artificial or natural material) winding machines and in particular to machines for winding yarn or tape which is delivered to the winder at a controlled or synchronous speed from a supply source such as an extruder.

It is very desirable with winders of this type to maintain a substantially constant tension on the yarn and tape being wound. The main cause of tension variation with a constant speed take-up spindle is the fact that as the diameter of the package being wound increases, the surface speed of the package (and hence the take-up speed of the yarn or tape), tends to increase but is restrained by the yarn or tape which is being delivered at a constant speed. This has the consequence of increasing the tension in the yarn or tape.

Various proposals have been put forward in an attempt to vary the drive to the take-up spindle to reduce the speed of rotation as the package diameter increases. Such proposals have hitherto tended either to be unduly complicated and expensive either to install or to maintain, or require too great an effort to operate to be useful when the tape or tape or yarn filament is light in weight.

The general object of this invention therefore is to provide a control for a variable speed driven take-up spindle which is suitable for a wide range of yarns or tapes particularly light weight yarn or tape being fed to the winder at a controlled speed.

A yarn or tape winder in accordance with this invention which satisfies this criteria comprises a take-up spindle which is arranged to be driven by a drive the torque/speed of which is variable in accordance with the setting of a torque variator device and a control device including means in the path of the tape or yarn prior to the take-up spindle to sense the tension in the tape or yarn and a control drive for the variator which is mechanically connected to the tension sensing means (preferably by a rotatable element) and which is effective to adjust the variator to alter the torque applied to the winding spindle when the yarn or tape tension varies beyond predetermined limits.

The advantage of having a drive for the variator as compared with an arrangement in which the variator is adjusted directly from the tension sensor, is that the sensor may be arranged so as to require very little force to move it and at the same time it can be arranged only to activate the drive for the variator when the tension varies beyond certain limits so as to avoid the condition in which any slight tremor in the yarn acts to adjust the spindle torque which would lead to a very unstable arrangement.

The control drive for the variator is preferably taken from the drive to the take-up spindle so that as the latter varies so does the former. This has the advantage that the speed of the take-up spindle varies rapidly during the initial build-up of a package on the spindle when the diameter of the package is small. The spindle speed on the other hand varies much more slowly once the package has reached significant size.

The spindle torque variator device may be of any convenient construction. One which is very effective comprises a magnetic drum and armature, one of which components is driven at a constant speed and the other of which transmits a drive to the spindle the strength of which depends on the position of the armature within the drum. The drive is at a maximum when the armature is located fully within the drum and a lesser drive is transmitted as the armature is moved progressively further out from the drum. When using such a variator device the control drive is arranged to cause a relative movement of the drum and armature.

The variator control drive is preferably adjustable so it can be disengaged either by an operator or automatically if the signal from the yarn or tape sensor continues despite a correction in the take-up spindle speed for example on the occasion of a yarn or tape breakage.

An embodiment of a yarn or tape winder in accordance with the invention will now be described by way of example and with reference to the accompanying drawings in which:-

Figure 2:
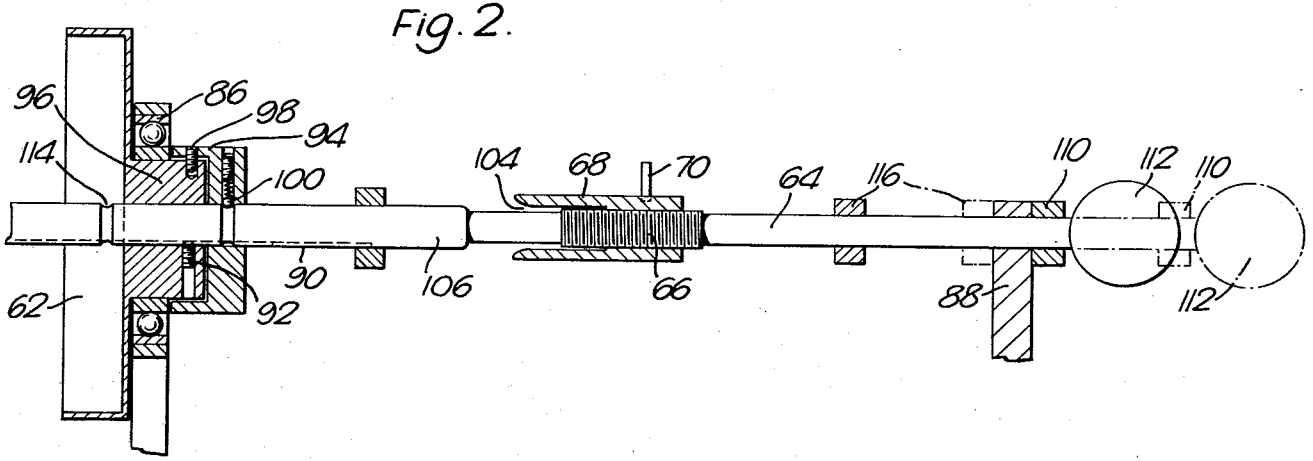

FIG. 1 is a perspective view of the main drive components of the winder, and FIG. 2 is a detailed side elevation of the means by which the control drive is transmitted to the spindle torque variator.

Referring to FIG. 1 the winder comprises a take-up spindle 2 on which a package generally indicated at 4, is wound. The spindle 2 is driven by a constant speed drive device (not shown), through a toothed belt 6 and a spindle torque variator device generally indicated at 8 the output shaft 10 of which carries a pulley 12 engaging a further toothed belt 14 which drives a pulley 16 at one end of the spindle 2.

The spindle is mounted in bearings in a bracket device 18 which can pivot as the size of the package 4 which is being formed on the spindle, increases.

The tape generally indicated at 20 is fed to the package through a guide eye 22 which is traversed along the length of the package by a standard traverse mechanism (not shown) housed in a traverse box 24. The traverse box carries a roller 26 which is placed against the side of the package 4 so as to produce a tightly wound package.

In order to achieve a precision wound package the traverse mechanism, as is conventional, is driven in a constant relationship with the package. In the winder illustrated this is achieved by taking a drive from the other end of the spindle speed variator output shaft 10. A drive roller 28 is mounted on the shaft and drives a further roller 30 through a belt 32. The roller 30 is connected to a toothed pulley 34 which transmits the drive through a toothed belt 36 to a pulley 38 mounted on the drive input shaft of the traverse mechanism. It will be appreciated that the arrangement of the spindle, package and traverse box are not illustrated in the drawing in true perspective, for the sake of clarity.

The spindle speed variator 8 comprises a drum 40 of magnetic material and an armature 42 carrying a number of magnets 43 which is movable axially into and out from the drum 40 with the magnets in close proximity to the interior surface of the drum, the armature slides along the shaft 10 to which it is splined so as to be able to transmit a rotational drive. The drum 40 is driven by the belt 6 and when the armature 42 is located fully within the drum 40 the maximum drive is transmitted to the spindle. As the armature 42 is moved progressively from the drum 40 (to the right as seen in the drawing) the drive is progressively weakened and hence the spindle torque will drop.

The armature is moved relatively to the drum by means of a control device which acts in accordance with the tension of the tape 20 to transmit a drive to the armature to move it axially along the shaft 10.

The control device includes a tension sensor in the form of a pulley 44 around which the tape passes before being wound on to the package 4. The pulley 44 is mounted at the end of a cranked arm 46 which is pivotally mounted (approximately at the position marked Y) to the machine frame (not shown). The arm 46 is connected to a torsion bar 48 which in turn is connected to an extension 50 of the same diameter as the rod 46.

The extension 50 carries a freely rotatable pulley 52 at its outer end which is driven by a belt 54 from the variator output shaft 10. The pulley 52 in its turn drives a belt 55 which drives two pulleys 56, 58 which are mounted for rotation on a triangular mounting plate 60. The plate 60 is fixed to the end of the rod 50.

The pulleys 56 and 58 are adapted to drive a dished wheel 62 fixed to a shaft 64. The pulley 56 is located within the rim of the wheel 62 whereas the pulley 58 is located outside the rim. When the winder is operating at the desired spindle torque and with the desired tension in the tape, neither of the pulleys 56 and 58 will engage the wheel 62 so that the shaft 64 will be at rest. If however the tension should vary during winding the pulley 44 which is resting within a loop of the tape 20 will be moved upwardly or downwardly causing a corresponding movement of the tension bar 48, rod 50 and plate 60. This causes one or other of the wheels 56, 58 to engage the rim of the wheel 62 and thus drive the shaft 64.

The shaft 64 is threaded over a length 66 and carries a nut 68 fitted with a pin 70. The pin 70 engages within the forked end 72 of an arm 74 which is pivoted at its other end 76 to the frame of the machine. The arm 74 carries an upstanding runner 78 which engages in a groove 80 of a collar 82 of the magnetic armature 42 so that movement of the arm 74 will cause a corresponding movement of the armature 42 within the drum 40.

In use the tape tension sensor may be adjusted by moving a balance weight 84 along the arm 46. Once the balance is set and the machine in operation, then, if for example, the tension in the tape increases caused possibly by an increase in the diameter of the package 4, the pulley 44 will lift. If this tension variation is small this will be taken up by the torsion rod 48 and by the pitch of the pulleys 56 and 58. Once the free play has been taken up further rotational movement of the torsion rod 48 will cause the pulley 56 to engage the inside of the rim of the wheel 62 causing a drive to be transmitted to the shaft 64 which has the effect of moving the nut 68 along the screw 66 pivoting the arm 64 in the direction to move the armature 42 out from the drum 40 and causing a reduction in the drive to the spindle. The torque of the winding spindle will then drop until the sensing pulley 44 again resumes its neutral position in which no drive is transmitted to the shaft 64 by either of the pulleys 56 or 58.

If, on the other hand, the tension in the tape is not sufficiently high the rod 46 will pivot downwardly causing the pulley 58 to engage the outer surface of the wheel 62 to drive the shaft 64 in the opposite direction to move the armature 42 further within the drum 40 to increase the spindle torque and hence increase the tape tension to the desired figure.

As can be seen more clearly in FIG. 2 the shaft 64 is arranged so that it can slide relatively to the wheel 62 in mountings 86 and 88. The shaft is formed with a keyway 90 which engages with a key 92 on the wheel 62 so that rotational drive is transmitted to shaft from the wheel. The wheel 62 is itself prevented from axial movement by a recessed washer 94 which is connected to a collar 96 of the wheel by means of a screw 98. This washer is provided with a spring loaded ball 100 which engages, in the normal winding position with a groove 102 in the shaft 64.

If the yarn or tape were to break the tension arm 46 would fall with the result that the shaft 64 would be constantly driven by the pulley 58 so as to screw the nut 68 to the left as seen in the drawings to move the armature 42 into the drum. In order to prevent the armature being driven hard up against the inner wall of the drum the length of the threaded portion 66 is made such that the nut 68 will run off the thread so as not to transmit any further drive to the armature. The nut does however remain centralised on the shaft 64 due to its being provided with unthreaded counter-bore 104 which locates on a portion 106 of the shaft 64 which is of larger diameter.

The arm 74 is biased by means of a spring 108 acting adjacent its pivot 76 in a direction towards the right as seen in the drawings so that the nut 68 is constantly urged towards the screw so that when the tape is restored and the shaft 64 commenced to rotate in the opposite direction so as to return the armature to its neutral position, the nut will instantly engage the screw to provide immediate operation.

During the repair of a yarn break an operator will require to remove the drive from the spindle and to do so all that is required is to slide the rod 64 bodily to the right, as seen in the drawing. This movement will cause the armature to be removed from the drum. In FIG. 2 the right-hand end of the shaft is shown dotted in the non-operative position. As already mentioned, in the normal operating position the shaft 64 is located by means of the ball catch 100 and groove 102. A washer 110 is fixed to the shaft 64 also locates against the mounting bracket 88. To retract the magnetic armature from the drum, and hence remove the drive to the spindle, a knob 112 is fixed to the end of the shaft 64, the shaft 64 is grasped and the shaft slid to the right until a second groove 114 is engaged by the ball catch and a washer 116 (as shown in broken lines) engages the frame 88. The wheel 62 of course, remains in the operative position at all times but with the nut disengaged from the thread of the shaft, rotation of the shaft has no effect on the position of the magnets. Once the yarn end has been repaired the shaft 64 is then slid back to its operative position.

In use the constant speed motor which drives the spindle shown in the drawings through the belt 6 can well be adapted to drive a number of spindles. The torque of each spindle will then vary according to the requirements of the separate spindles because of the use of a torque variator device 8 with each spindle.

The tension arm 46 is comparatively easy to move as it does not itself have to drive or move any part of the torque variator but merely acts to initiate a drive for the variator. Consequently the winder can be used with comparatively light weight tape, yarn or yarn filaments.

I claim:

1. A yarn or tape winding machine comprising:

a take up spindle for winding said yarn or tape, drive means for rotating a member at a controlled speed, torque transmitting variator means including said member for transmitting a controlled torque to said take up spindle, control means for controlling the torque transmitted by said torque transmitting variator means, said control means including a second member connected to said torque transmitting variator means, power means connected to said second member for driving said second member, and sensing means connected to said power means for sensing said yarn or tape tension and adjusting said torque transmitting variator means by controlling said power means to move said second member when said yarn or tape tension varies beyond predetermined limits.

2. The device of claim 1 wherein said power means is driven by said torque transmitting variator means.

3. The device of claim 1 in which said power means includes:

an assembly secured for pivotal movement about an axis, two driven rotating elements, each mounted on said assembly, a flanged disc, said disc mounted for rotatable movement about an axis with said flange positioned between said rotating elements and adapted to be driven in one direction or another by one or another of said rotating elements in response to pivoting movement of said elements in one direction or another, shaft means coupled to said flanged disc and to said second member for driving said second member in response to rotation of said shaft, said sensing means coupled to said assembly for pivoting said assembly in one direction or another in response to yarn or tape tension variations beyond predetermined limits in one sense or another.

4. The device of claim 1 in which said power means includes:

a threaded member, and means for rotating said threaded member in one direction or another in response to said sensing means sensing yarn or tape tension variations beyond predetermined limits in one sense or another, a nut threadedly engaging said threaded member and driven thereby in one direction or another in response to said rotation of said threaded member in one direction or another, coupling means secured for movement with said nut, said second member coupled to said nut by said coupling means, said coupling means moving said second member in one direction or another in rsponse to movement of said nut in one direction or another.

5. The device of claim 1 in which said power means is coupled to and driven by said torque transmitting variator means, manually operable means for preventing said power means from driving said second member, and limiting means for limiting the driving of said second member by said power means.

6. The device of claim 1 in which said torque transmitting variator means comprises a magnetic drum and armature, said drive means comprising a constant speed drive coupled to one of said magnetic drum and armature comprising said member, the other of said magnetic drum and armature comprising a means for transmitting a controlled torque to said take up spindle, means for mounting said magnetic drum and armature to provide relative movement therebetween in a direction parallel to an axis common to said magnetic drum and armature, said second member including means for providing said relative movement between said magnetic drum and armature in a direction parallel with an axis common to both said magnetic drum and armature.

7. The device of claim 1 in which said sensing means includes:

a crank arm rotatable about an axis with a yarn or tape engaging means at a free end thereof, a torsion bar with a first and second end, means for mounting said torsion bar coincident with said axis, said means for mounting coupling said crank arm and said torsion bar at said first end, and also coupling said power means and said torsion bar at said second end.

8. The device of claim 7 wherein said power means includes assembly means secured for pivotal movement about an axis in response to rotation of said second end of said torsion bar, two rotating elements driven by said torque transmitting variator means and mounted on said assembly means, a flanged disc, said disc mounted for rotatable movement about an axis with said flange positioned between said rotating elements and adapted to be driven in one direction or another by one or another of said rotating elements in response to the pivoting movement of said elements in one direction or another, and a shaft coupled to said flanged disc and to said second member for driving said second member in response to rotation of said shaft.

* * * * *